US010566122B2

(12) United States Patent
Mehta

(10) Patent No.: US 10,566,122 B2
(45) Date of Patent: Feb. 18, 2020

(54) SOLENOID HOUSING AND METHOD OF PROVIDING A SOLENOID HOUSING

(71) Applicant: Shreyas R. Mehta, White Plains, NY (US)

(72) Inventor: Shreyas R. Mehta, White Plains, NY (US)

(73) Assignee: Indimet Inc., White Plains, NY (US)

( * ) Notice: Subject to any disclaimer, the term of this patent is extended or adjusted under 35 U.S.C. 154(b) by 343 days.

(21) Appl. No.: 15/466,403

(22) Filed: Mar. 22, 2017

(65) Prior Publication Data

US 2017/0243685 A1 Aug. 24, 2017

Related U.S. Application Data

(60) Division of application No. 13/568,758, filed on Aug. 7, 2012, now Pat. No. 9,636,741, which is a continuation-in-part of application No. 12/102,392, filed on Apr. 14, 2008, now Pat. No. 8,261,592.

(60) Provisional application No. 60/989,649, filed on Nov. 21, 2007.

(51) Int. Cl.

| | |
|---|---|
| ***H01H 9/02*** | (2006.01) |
| ***H01F 7/126*** | (2006.01) |
| ***B21J 5/06*** | (2006.01) |
| ***B21K 1/26*** | (2006.01) |
| ***B21D 51/10*** | (2006.01) |
| ***B21D 51/16*** | (2006.01) |
| ***B21K 1/24*** | (2006.01) |

(52) U.S. Cl.

CPC ..... *H01F 7/126* (2013.01); *B21D 51/10* (2013.01); *B21D 51/16* (2013.01); *B21J 5/06* (2013.01); *B21K 1/24* (2013.01); *B21K 1/26* (2013.01)

(58) Field of Classification Search

CPC ..... H01F 27/02
USPC ..... 336/90; 335/297
See application file for complete search history.

(56) References Cited

U.S. PATENT DOCUMENTS

| | | | | |
|---|---|---|---|---|
| 2,190,303 | A * | 2/1940 | Wantz | H05B 1/02 335/181 |
| 2,523,515 | A * | 9/1950 | Porter | G11B 5/127 174/352 |
| 2,628,342 | A * | 2/1953 | Taylor | H04M 1/02 336/107 |
| 4,717,901 | A * | 1/1988 | Autenrieth | H01F 17/02 336/192 |
| 5,844,459 | A * | 12/1998 | Larsen | H01F 27/306 336/92 |
| 8,350,652 | B2 * | 1/2013 | Hoppe | F01L 1/3442 310/12.31 |
| 8,803,647 | B2 * | 8/2014 | Saka | H01F 27/22 219/624 |
| 9,786,425 | B2 * | 10/2017 | Sakaguchi | H01F 37/00 |
| 2005/0016246 | A1 * | 1/2005 | Yamanaka | B21C 23/205 72/355.6 |
| 2006/0119458 | A1 * | 6/2006 | Roy | B25B 11/002 335/289 |

(Continued)

*Primary Examiner* — Alexander Talpalatski
(74) *Attorney, Agent, or Firm* — IP Attorneys Group, LLC

(57) ABSTRACT

This invention relates to a solenoid housing and to a method for providing a solenoid housing having the base, wall, center pole, and flange integrally connected as a single piece. The instant invention provides for mounting protrusions and window for electrical leads as an integral part of the housing and manufacturing process.

7 Claims, 9 Drawing Sheets

(56) References Cited

U.S. PATENT DOCUMENTS

| | | | | |
|---|---|---|---|---|
| 2006/0132273 | A1* | 6/2006 | Shinmen | H01F 3/10 336/200 |
| 2007/0006628 | A1* | 1/2007 | Tabei | B21J 5/06 72/348 |
| 2008/0257009 | A1* | 10/2008 | Mehta | B21K 1/24 72/377 |

* cited by examiner

FIG. 9A
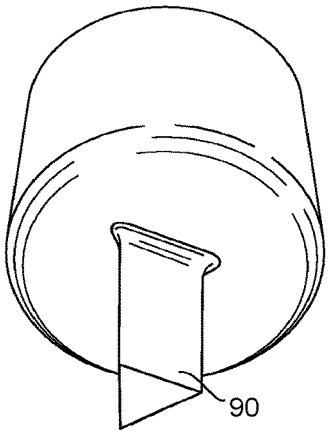
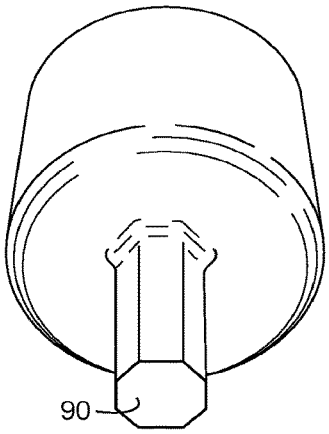
FIG. 9B
FIG. 9C
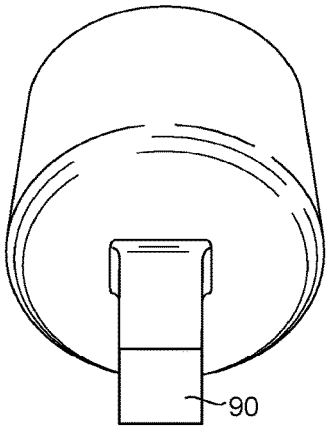
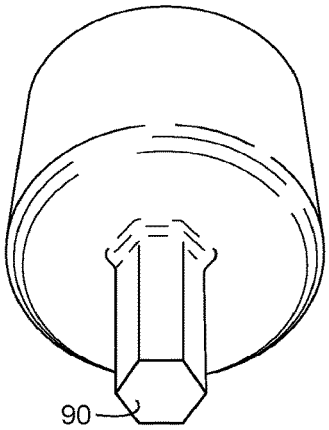
FIG. 9D

SOLENOID HOUSING AND METHOD OF PROVIDING A SOLENOID HOUSING

CROSS REFERENCE TO RELATED APPLICATIONS

This application is a divisional of U.S. patent application Ser. No. 13/568,758, filed on Aug. 7, 2012 and titled "Solenoid Housing and Method of Providing a Solenoid Housing," which is a continuation-in-part of U.S. Pat. No. 8,261,592, filed on Apr. 14, 2008 and titled "Method of Providing a Solenoid Housing," which claims priority to and the benefit of Indian Patent Application No. 848/CHE/2007 filed on Apr. 19, 2007, and further claims priority to and the benefit of U.S. Provisional Patent Application Ser. No. 60/989,649, filed on Nov. 21, 2007 and titled "Method for Reducing Material Waste." The above-captioned applications are herein incorporated by reference in their entireties.

FIELD OF INVENTION

This invention relates to solenoid housings, and especially to an improved solenoid housing machined with integrated protrusions from a single piece of metal; and to methods for providing the same.

BACKGROUND OF INVENTION

Solenoid housings are typically used in car control systems, such as doors, windows, hydraulic controls, engine controls, and the like. Other uses include refrigerators, washers, and dryers. Further uses include electronically actuated valves and switches, door holders, speakers, and CRT monitors.

A solenoid housing is typically assembled from multiple components, with each component being typically machined, bent, or molded into shape individually prior to assembly. Each piece is then typically assembled via a nesting or welding method to create the composite structure of the housing.

There are distinct disadvantages to this method of forming a solenoid housing. Nesting or welding of components can create weak points at the interfaces between said components. These weak points may be structural, in that the resiliency of the housing at these interfaces is inferior to that of each component themselves with the housing likely to fail at these interfaces. Said weak points may also be electromagnetic in nature, meaning flow of electrical and magnetic fields around the solenoid housing may be impeded at these interfaces.

Machining and then assembling the various components of the solenoid housing may also shorten the operational lifetime of the solenoid housing. The manufacturing errors of a multi component assembly are aggregate, meaning that the potential minute deviations of each manufactured component from a target size and shape must be taken into account during assembly. Therefore, solenoid housings assembled in the prior art manner have limitations with regards to error tolerances; it is difficult to design components to fit finely, like on a micrometer scale, because the inherent variation in the prior art machining process typically cannot produce the desired components with sufficient reliability. In a kinetic apparatus such as a solenoid, the above-mentioned deviations can cause friction between components and limited operational lifetimes. Additionally, having to machine multiple components (multi-setting machining) vastly increases the complexity of the solenoid housing, meaning greater skill, time, and ultimately money are typically required to produce one operational product versus a simpler, single-setting machining process.

Once assembly is completed, a solenoid housing typically undergoes a finishing step, often called "deburring." Deburring removes rough edges, excess and unwanted material, and produces a more polished product. It is not uncommon for solenoid housings to be fashioned from low-carbon steel. However, traditional deburring methods have difficulty with low-carbon steel solenoid housings.

What is desired, therefore, is a deburred solenoid housing machined with integrated protrusions from a single piece of metal. Another desire is a method of making a solenoid housing that reduces weak points in the housing construct without sacrificing performance or manufacturing efficiency. Another desire is a method of making a solenoid housing that allows for single-setting machining. Finally, what is desired is a method that allows for efficient deburring of low-carbon steel solenoid housings.

SUMMARY OF INVENTION

It is therefore an object of this invention to provide a solenoid housing. In one embodiment, the solenoid includes a base, a raised wall extended from the base having an outer perimeter, at least one protrusion extended from the outer perimeter, at least one hole in said at least one protrusion, and a center pole, wherein the first perimeter, raised wall, protrusions, and center pole are integrally connected as a single piece. In some embodiments, the protrusions are generally perpendicular to the raised wall. In some embodiments, the protrusions are located on the edge of the raised wall furthest from the base.

In some embodiments, the solenoid housing also includes at least one window. This window is a through-hole between the outside and inside of the solenoid housing. In some embodiments, a window is formed in the raised wall of the housing. In some embodiments, a window is formed through the base of the housing. In some embodiments, the window is a notch in the housing through the flange and the edge of the raised wall furthest from the base. In some embodiments, a second window is formed opposite to a first window. In some embodiments, the solenoid housing also includes at least one electrical lead extending through at least one window.

It is also an object of this invention to provide a method for making a solenoid housing. In some embodiments, this method includes providing a solid cylinder; extending the perimeter of the cylinder to form a raised wall; extending a pole from the cylinder; and shaping the raised wall to form a flange. In these embodiments, the base of the cylinder, perimeter, raised wall, and flange are all integrally connected as a single piece. In some embodiments, the base of the cylinder, perimeter, raised wall, pole, and flange are all integrally connected as a single piece.

In some embodiments, the step of shaping the raised wall to form a flange includes the step of bending the raised wall to form a flange substantially perpendicular to the raised wall. In some embodiments, the method includes the step of forming at least one protrusion on the flange, on the raised wall, or both. In some embodiments, the method includes the step of providing at least one hole in at least one of the protrusions so formed.

In some embodiments, the method includes annealing the solenoid housing before any of the previously mentioned steps. In some embodiments, the method also includes part coating the solenoid housing before any of the previously mentioned steps.

In some embodiments, the method includes the further step of electrochemical deburring of the solenoid housing. In some embodiments, this electrochemical deburring includes the steps of immersing the solenoid housing into an electrolyte solution containing a solvent, a salt, and an insulator, providing a cathode and an anode, and applying a voltage between the cathode and the anode. In some embodiments, the electrolyte solution contains water, sodium nitrate, and a substance selected from mono-ethylene glycol, di-ethylene glycol, glycerine, and combinations thereof.

In some embodiments, the method includes the further step of providing at least one window to said solenoid housing. In some embodiments, the method includes the further step of part squeezing the solenoid housing. In some embodiments, the method includes the further step of hardening the solenoid housing. In some embodiments, the method includes the further step of providing at least one electrical lead through at least one window.

In some embodiments of this invention, the step of forming at least one protrusion includes the step of stamping the raised wall.

In one embodiment, this invention provides a method for forming a solenoid housing including the steps of providing a solid cylinder having a perimeter; extending the perimeter to form a raised wall; extending a pole from the cylinder; bending the raised wall to form a flange substantially perpendicular to the raised wall; forming at least one protrusion on the raised wall, flange, or combinations of the two; providing at least one hole in at least one protrusion; providing at least one window to the solenoid housing; part squeezing the solenoid housing; electrochemical deburring, hardening the housing, and providing at least one electrical lead through at least one window. In some embodiments, one or more of these steps are carried out substantially at room temperature. In some embodiments, the method includes the additional steps of annealing and part-coating the solenoid housing before at least one of the steps of extending the perimeter to form a raised wall; extending a pole from the cylinder; bending the raised wall to form a flange substantially perpendicular to the raised wall; forming at least one protrusion on the raised wall, flange, or combinations thereof; providing at least one hole in at least one protrusion; providing at least one window to the solenoid housing; part squeezing the solenoid housing; electrochemical deburring, hardening the housing, and providing at least one electrical lead through at least one window.

In some embodiments of this invention, the step of electrical deburring includes the steps of providing the solenoid housing to an electrolyte solution comprising a solvent, a salt and an insulator; providing a cathode and an anode; and applying a voltage between the cathode and the anode. In some embodiments of this invention, the electrolyte solution comprises water, sodium nitrate, and a substance selected from the group consisting of mono-ethylene glycol, di-ethylene glycol, glycerine; and combinations thereof. In some embodiments of this invention, the method step of hardening the solenoid housing includes the step of treating the solenoid housing by a ferritic nitrocarburizing process.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may be understood by reference to the detailed description which follows taken in conjunction with the accompanying drawings in which the drawings show typical embodiments of the invention and are not intended to be limited of its scope.

FIGS. 9A-9D depicts a bottom view of the solenoid housing as depicted in FIG. 1.

DETAILED DESCRIPTION

In describing the various embodiments of the invention, reference will be made to FIGS. 1-9, of the drawings, in which like numerals refer to like features of the invention.

Figure 1A:
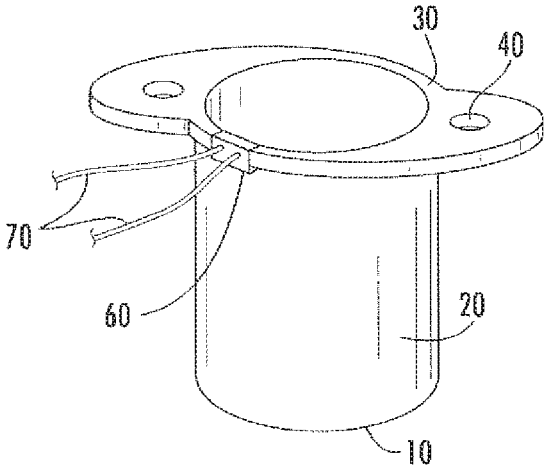
FIGS. 1A-1C depict a solenoid housing in accordance with the present invention in three views, FIG. 1*a* being an isometric view of the housing, FIG. 1*b* being a cutaway view of the housing to show the interior detail, and FIG. 1*c* being a top view of the housing.
Figure 1B:
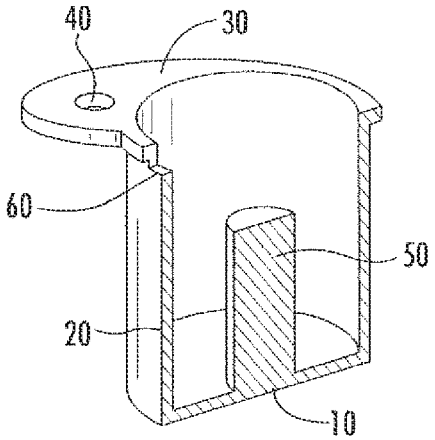
Figure 1C:
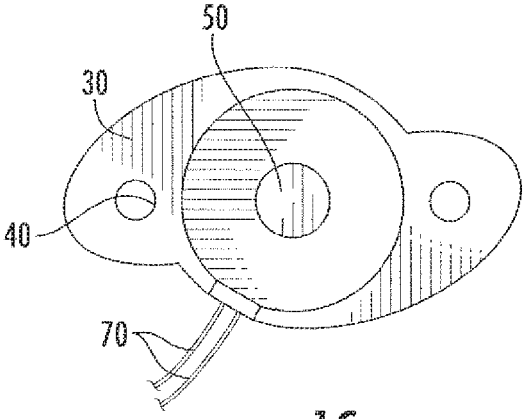
Figure 2A:
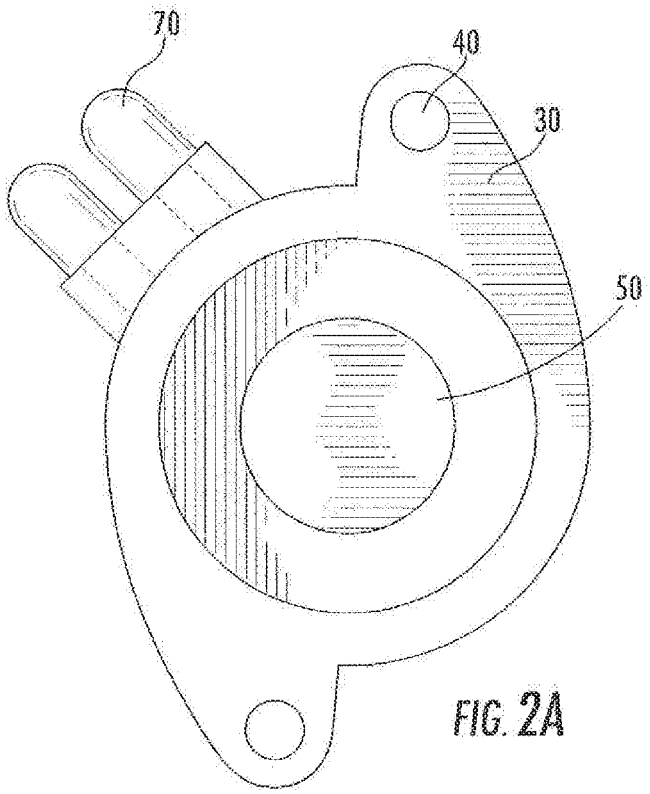
FIGS. 2A and 2B depict an embodiment of the solenoid housing depicted in FIG. 1, FIG. 2*a* being a side view and FIG. 2*b* being a top view.
Figure 2B:
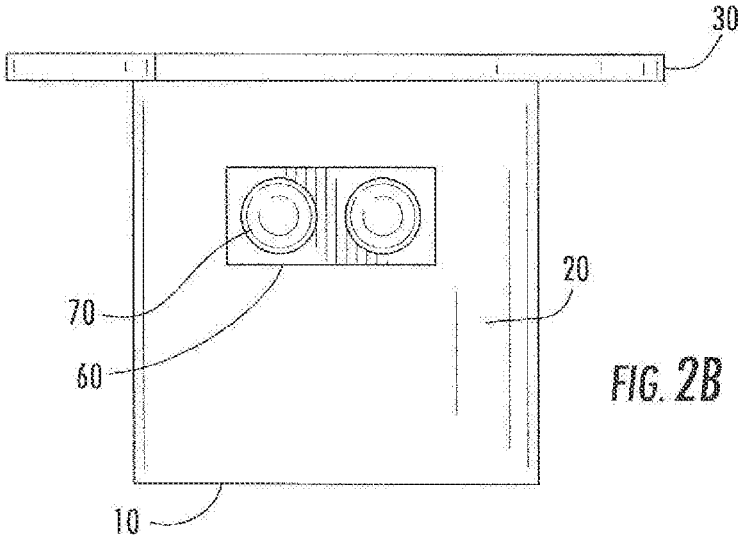

FIGS. 1*a*, 1*b*, and 1*c* depict a solenoid housing in accordance with the present invention. FIG. 1*a* is a side view of the housing, FIG. 1*b* is a cutaway view showing the inner structure of the housing, and FIG. 1*c* is a top view of the housing. These figures depict a solenoid housing comprising a base (10), a raised wall extending from the base (20), protrusions extending from the outer perimeter (30), a hole in each protrusion (40), and a center pole (50), all integrally connected as a single piece. In this embodiment, a window (60) is formed in the upper rim of the raised wall, and an electrical lead (70) is provided through the window. In one embodiment, a second window is formed opposite to a first window. The forming of a second window advantageously reduces any stresses due to asymmetry of the finished housing, and relieves any tendency of the housing to warp during or after manufacture.

This embodiment is cold-forged from a single unit of a solid cylinder of malleable metal. Cold forging from a single cylinder minimizes material loss typically associated with cutting or machining, which result in waste by removal of material. This also reduces the manufacturing time and complexity associated with assembly, cutting, drilling, and machining of traditional solenoid housings. A further advantage is the elimination of joints and seams caused by prior art welding or nesting methods of fabricating a composite structure. These joints and seams inherently introduce weak points which lead to shorter operational lifetimes and lower tolerances to stress. In some embodiments, a low carbon steel such as SAE 1006, 1008, 1010, or the like is used.

Figures 3A, 3B, 3C, 3D, 3E:
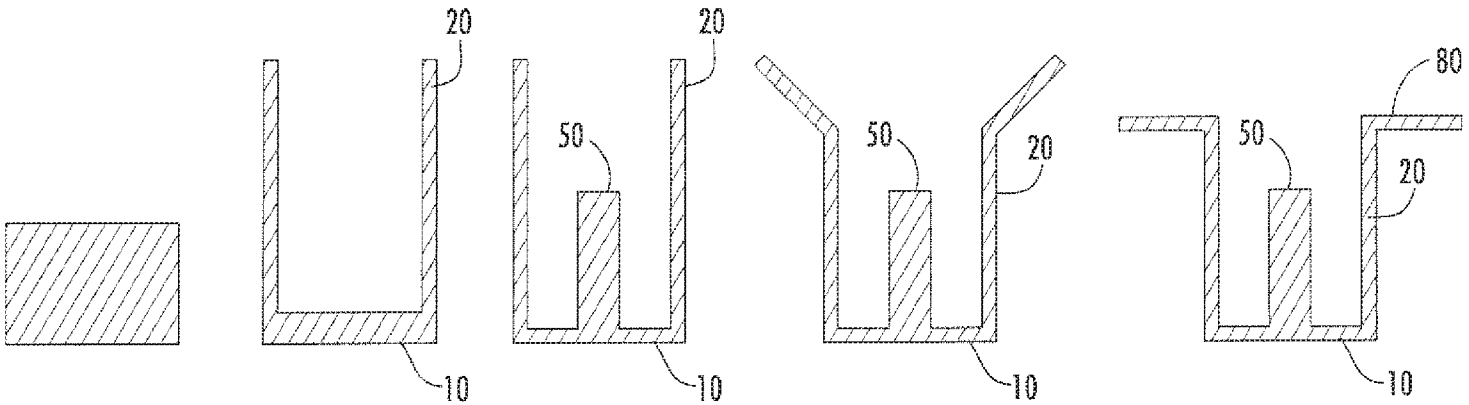
FIGS. 3A-3E depict cross-section views of the solenoid housing in FIG. 1.
Figures 4A, 4B, 4C, 4D:
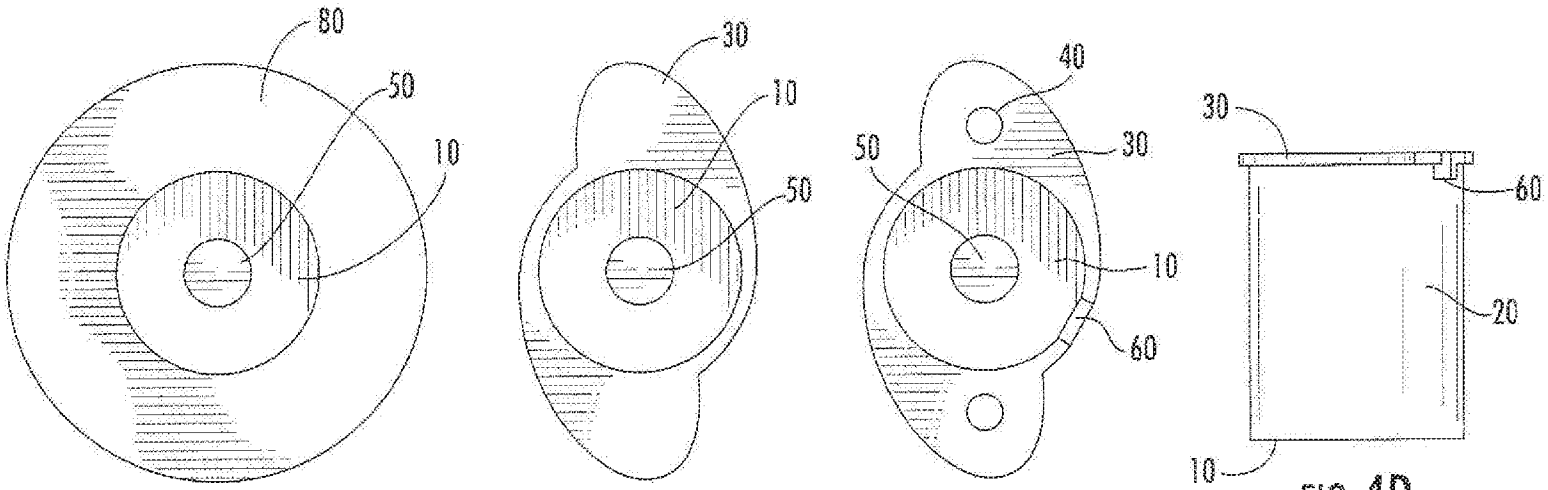
FIGS. 4A-4C depict a top view of the solenoid housing of FIG. 1.
FIG. 4D depicts a side view of the solenoid housing of FIG. 1

FIGS. 3 and 4 depict one embodiment of the invention at several stages during the forming process. In this embodiment, the solenoid housing is formed by providing a solid cylinder of malleable material (FIG. 3*a*) which has been annealed and lubricated. This cylinder is placed in a die, and a punch is pressed downwards into the material, extruding a raised wall (20) upwards from the perimeter of the solid cylinder to give the form shown in FIG. 3*b*. A second punch with an opening in the center is then pressed into the cylinder, raising a post (50) in the center of the form to give the form shown in FIG. 3*c*. A flange (80) is formed by pressing the upper edge outwards until it is perpendicular to the raised walls. This can conveniently be done in two operations, first using a cone-shaped form to press the flange outwards to a 45 degree angle with the raised wall (FIG. 3*d*), then using a second, flat form to press the flange down to a 90 degree angle with the raised wall to give the form shown as a side view in FIG. 3*e* and top view in FIG. 4*a*. The flange is pressed into a die to shape the protrusions (30) to give the form shown in FIG. 4*b*, a window (60) is cut into the housing to provide an opening for electrical leads, and mounting holes (40) are punched into the protrusions to give the form shown in FIG. 4*c* as a top view and FIG. 4*d* as a side view. In one embodiment, a second window is cut into the housing, either simultaneously with a first window or after the formation of the first window.

In some embodiments, a final part-squeezing step is added to fix the final dimensions of the housing. In this step, the housing is pressed into a form whose inner dimensions match the outer dimensions desired in the finished product. This part-squeezing step is desirable to remove any distortions in the geometry of the shape caused by the punching and cutting operations.

In some embodiments, the one or more protrusions are formed by stamping the raised wall.

In one embodiment, the above extrusions and cold working steps are carried out at room temperature. In other embodiments, the temperature of the material is raised to facilitate extrusion or to avoid the wait time between annealing operations, which are typically carried out at an elevated temperature.

In some embodiments, the form is annealed after each step of the previously described process. Annealing is beneficial because it reduces the stresses introduced into the material during extruding, or during cold working, which occurs each time the material is pressed into dies, bent, or otherwise shaped. Without annealing, the material becomes more brittle and more difficult to shape in each subsequent step, with an added likelihood of cracking or failure. In other embodiments, depending on the nature of the material being worked and of the stresses applied by the operation, two or more steps are carried out before it is necessary to anneal the form. Because annealing is a time and energy consuming process, it need only be carried out as frequently as necessary to prevent unacceptable failure rates in the subsequent step.

In some embodiments, the material is coated to facilitate extruding, and is recoated after subsequent annealing operations. In some embodiments, substances such as phosphates, lubricants, oils, surfactants, or emulsions are used for part coating the material before subsequent operations.

In some embodiments, the solenoid housing is electrochemically deburred. Raised particles, surface projections, and shavings that appear when metal blanks are machined are referred to as "burrs". Many machining processes, including cutting, welding, molding, casting, trimming, slitting, shearing, drilling, punching, and forming can create these burrs. Burrs are undesirable on the final product and on many intermediate stages, because they can damage the form being machined and the machines and tools which are being used, and can injure the operators handling the forms.

Deburring is the process of removing burrs from edges and surfaces of the form being machined. Traditionally, this is done by mechanical means, including grinding, sanding, polishing, and blasting. These operations are labor intensive, and can damage the workpiece by cutting into portions of the workpiece below the burrs, most especially by undesirably rounding sharp edges and corners or reducing surfaces below acceptable tolerances. Recesses on the workpiece are also difficult to reach with available mechanical deburring tools.

The use of electrochemical deburring circumvents many of the disadvantages encountered in mechanical deburring. Electrochemical deburring works on the principle of electrolysis, wherein two electrodes, an anode and a cathode, are immersed in a suitable electrolyte and a potential difference is applied across the electrodes using an external electrical source. This promotes a chemical reaction wherein material from the anode is removed. When the workpiece is attached to or used as the anode, undesired material such as burrs and shavings can be removed without damaging the workpiece. Electrolytes typically consist of an ionic compound dissolved in a solvent to create a conductive solution.

In some embodiments of the invention, therefore, the solenoid housing is electrochemically deburred after the forming process is complete. In some embodiments, electrochemical deburring is carried out after any step in the forming process. Electrochemical deburring after intermediate steps in the process has the advantage of removing burrs and imperfections which present a hazard to operators setting up subsequent steps, or which would damage the workpiece or the tools involved in subsequent steps. In some embodiments, electrochemical deburring further comprises the steps of providing the solenoid housing to an electrolyte solution, providing a cathode and an anode, and applying a voltage between the cathode and anode. In some embodiments, the solenoid housing is electrically connected to the cathode so that the housing acts as the anode in the electrical deburring process.

Electrolysis as it is normally practiced has its own disadvantages as a deburring technique. Many effective electrolytes are highly corrosive, and require the use of expensive anti-corrosive materials for fabrication of the electrolytic apparatus. The corrosivity of the electrolyte can also cause corrosion on the workpiece, making it difficult to control burr removal to appropriate tolerances. Further, stray currents in the electrolyte disrupt the "skin effect" which would otherwise desirably concentrate the effect of the electrochemical deburring on the seams and edges of the workpiece, rather than spreading it across the surface of the workpiece. This requires that the cathode be machined to close tolerances to concentrate the deburring process in the appropriate areas, increasing the complexity and reducing the flexibility of the process. Finally, the heat generated by the process can evaporate the solvent, leading to undesired salt deposits on the workpiece and necessitating the use of larger volumes of electrolyte solution to dissipate heat and minimize the effects of evaporation.

Many of these disadvantages can be reduced or overcome by adding an insulator to the electrolyte solution to make the electrolyte behave like a semi-conductor. In some embodiments of the invention, therefore, the electrochemical deburring is carried out in an electrolyte comprising a solvent, a salt, and an insulator. In one embodiment of this invention, the electrolyte solution comprises water, sodium nitrate, and a substance selected from the group consisting of mono-ethylene glycol, di-ethylene glycol, glycerine, and combinations thereof.

In many applications it is desirable that the interior and exterior portions of the solenoid housing be electrically connected. In some embodiments of the invention, therefore, the method of providing a solenoid housing includes the step of providing at least one window to said solenoid housing. This window is an opening or through-hole between the outside and the inside of the volume defined by the solenoid housing. In some embodiments, the window is in the form of a notch in the distal edge of the raised wall, that portion of the wall furthest from the base of the solenoid housing. In some embodiments in which the solenoid housing also includes a flange or protrusions on the distal edge of the raised wall, the notch also extends through either the flange, one or more protrusions, or through portions of both the flange and one or more protrusions.

In other embodiments, the window is in the form of an opening through the raised wall. In still other embodiments, the window is in the form of an opening through the base of the solenoid housing.

In some embodiments, the method of providing a solenoid housing includes the step of providing a second window opposite to a first window. The provision of a single window into the solenoid housing requires additional care to ensure that the asymmetry of the housing does not cause warping or deformation of the housing either during manufacture or during subsequent use. The provision of a second window opposite to a first window, either at the same time or subsequent to the provision of a first window, reduces the chance that the housing will warp.

In some embodiments of the current invention, the solenoid housing is hardened. Hardening is a process of treating metal to increase its resistance to plastic deformation. This treatment is desirable once the solenoid housing has attained its final form, because it helps prevent the housing from being damaged or deformed by accidental impacts, abrasion, or forces involved in subsequent use and assembly.

Typical hardening processes include work-hardening and heat treatment methods. Work-hardening methods increase hardness by straining the material past its yield point to create dislocations in the grain structure of the metal. The presence of these dislocations makes it more difficult for new dislocations to form and increases the yield strain of the material. Work hardening is a normal effect of any cold-working operation, but for any but simple shapes, it is difficult to produce evenly work-hardened pieces, and unevenly hardened workpieces contain internal stresses which can make the final product susceptible to cracking or failure due to impact or vibration.

Heat treating hardening methods rely on temperature control to change the grain structure of the workpiece. The workpiece is heated to the point where some movement of elements inside the metal alloy is possible without reaching a temperature high enough to deform the workpiece. The workpiece is then cooled at a rate chosen to produce a new grain structure giving the desirable hardness in the finished material. The major disadvantages of heat treating methods is that some deformation of the workpiece due to the elevated temperature is very difficult to avoid, and the resulting material is the same hardness throughout, possibly leaving the material brittle.

Case hardening is another hardening technique which allows the surface layers of the material to have a different hardness than the internal portion of the material. For example, the internal portion is relatively soft and therefore resistant to cracking, while the surface is much harder and therefore resistant to deformation or abrasion. For steel, this has traditionally involved a heat treating process in the presence of high levels of carbon, which produces a thin layer of hard, high-carbon steel on the outside of the workpiece.

A hard surface can be generated at a lower temperature by the process of ferritic nitrocarburizing. This process diffuses nitrogen and carbon into ferrous metals at relatively low temperatures, typically less than 600° C. At these temperatures, there is very little heat distortion of the workpiece, and the hardened surface has improved abrasion resistance, corrosion resistance, and fatigue properties. In some embodiments of the invention, therefore, the solenoid housing is hardened by treatment with a ferritic nitrocarburizing process.

In some embodiments, one or more electrical leads are attached to the solenoid housing. In some embodiments, these provide an electrical connection between the outside of the solenoid housing and the inside of the housing. In some embodiments, one or more electrical leads are threaded through the window provided in the solenoid housing. In some embodiments, one or more electrical leads are attached to a secondary fitting which is mounted to the window provided in the solenoid housing. In some embodiments, the fitting is composed of an insulating material such that the electrical lead does not contact any surface of the solenoid housing. In some embodiments, the fitting is composed of a rubber or plastic material which is press-fitted into the window. In some embodiments in which the window is a notch in the distal edge of the raised wall and the flange, the fitting fills the notch such that the upper surface of the fitting and the distal edge of the raised wall form a continuous level surface.

Figure 5:
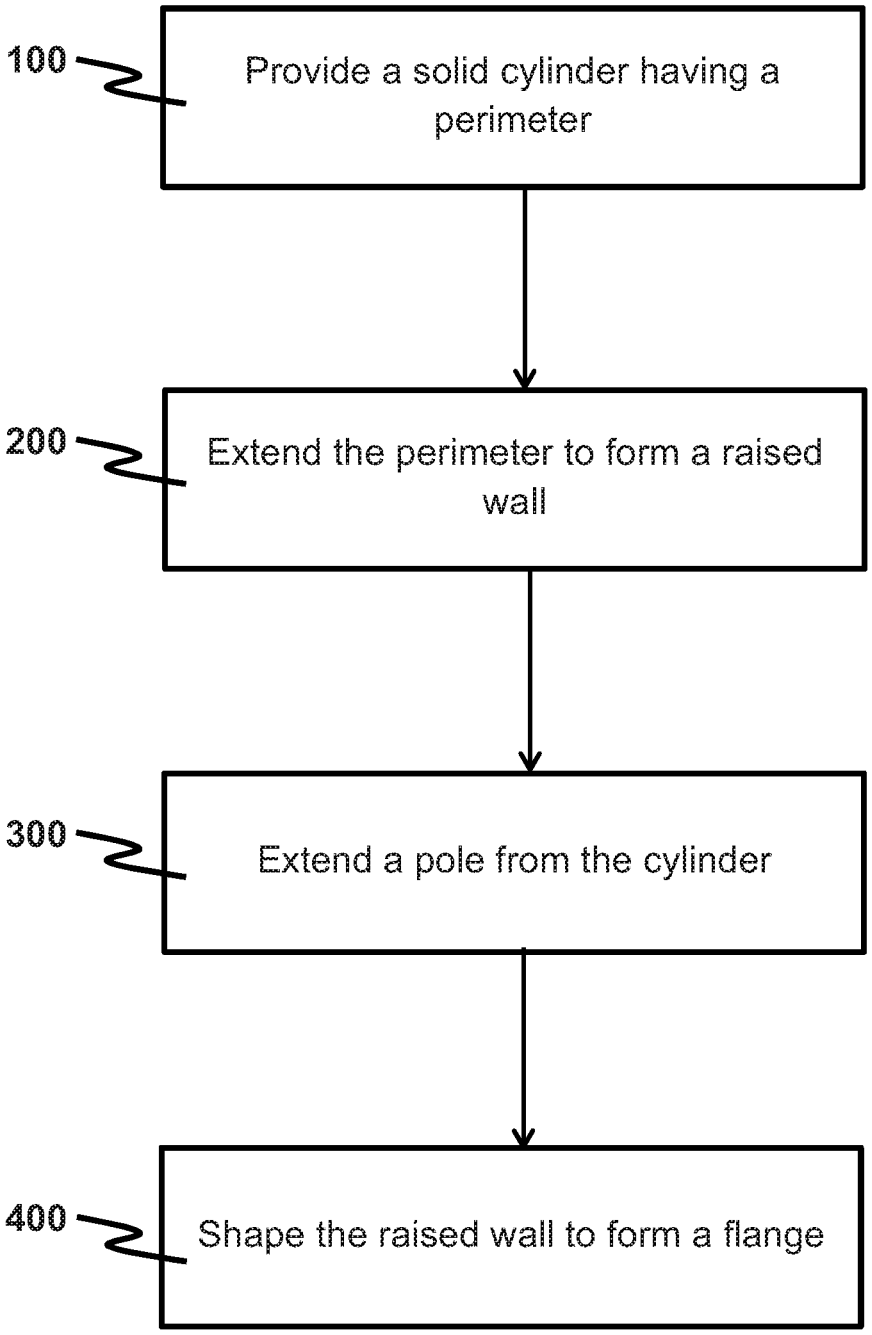
FIG. 5 s a flowchart depicting a method for providing the solenoid housing as depicted in FIG. 1.

FIG. 5 depicts on embodiment of the invention, a method for providing a solenoid housing in accordance with the current invention. This method includes the steps of providing a solid cylinder of malleable material (100), extending a perimeter to form a raised wall (200), extending a pole from the cylinder (300), and shaping the raised wall to form a flange (400).

Figure 6:
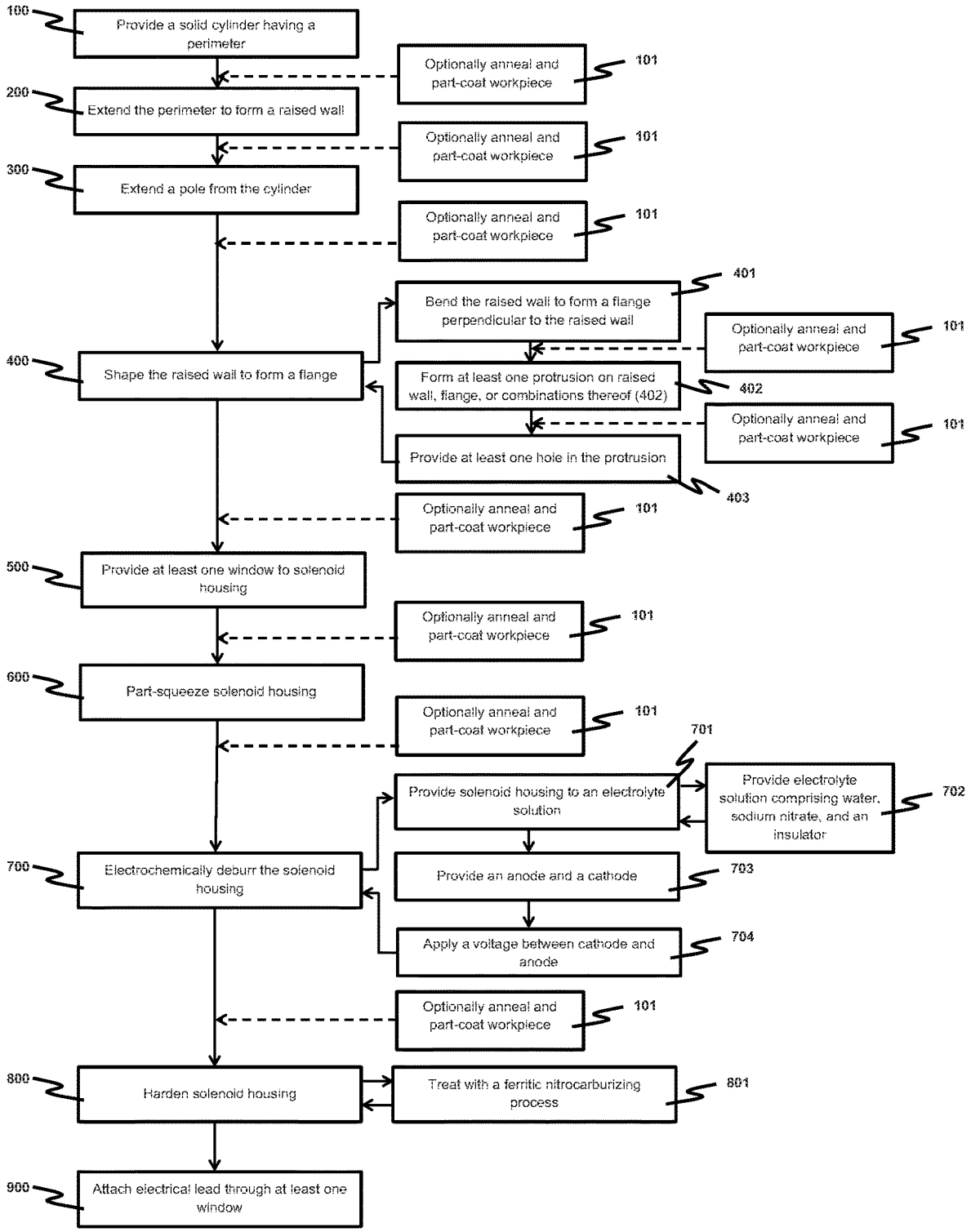
FIG. 6 is a flowchart depicting a method for providing the solenoid housing as depicted in FIG. 1.

FIG. 6 depicts additional embodiments of the invention, further methods for providing a solenoid housing in accordance with some embodiments of the current invention. In some embodiments, the step of shaping the raised wall includes the additional steps of bending the raised wall to form a flange perpendicular to the raised wall (401), forming at least one protrusion on the raised wall, the flange, or combinations thereof (402), and providing at least one hole in at least one protrusion (402). In some embodiments, the invention includes one or more of the additional steps of providing at least one window to the solenoid housing (500), part-squeezing the solenoid housing (600), electrochemically deburring the solenoid housing (700), hardening the solenoid housing (800) and attaching at least one electrical lead through at least one window (900). In some embodiments of the invention, the step of electrochemically deburring the solenoid housing includes the steps of providing the solenoid housing to an electrolyte solution (701), providing an anode and cathode (702), and applying a voltage between cathode and anode (703). In some embodiments, the step of providing the solenoid housing to an electrolyte solution includes the step of providing an electrolyte solution comprising water, sodium nitrate, and a substance chosen from mono-ethylene glycol, di-ethylene glycol, glycerine, and combinations thereof. In some embodiments, the step of hardening the solenoid housing includes the additional step of treating with a ferritic nitrocarburizing process (801).

Various embodiments of the method of the current invention include the step of optionally annealing and part-coating the workpiece (101) before or after one or more of the following steps—providing the cylinder, extending the perimeter of the cylinder to form a raised wall, extending a pole from the cylinder, shaping the raised wall to form a flange, forming the protrusions, providing holes in the protrusions, providing a window to the housing, part-squeezing the housing, electrochemically deburring the solenoid housing, and hardening the solenoid housing.

Figure 7:
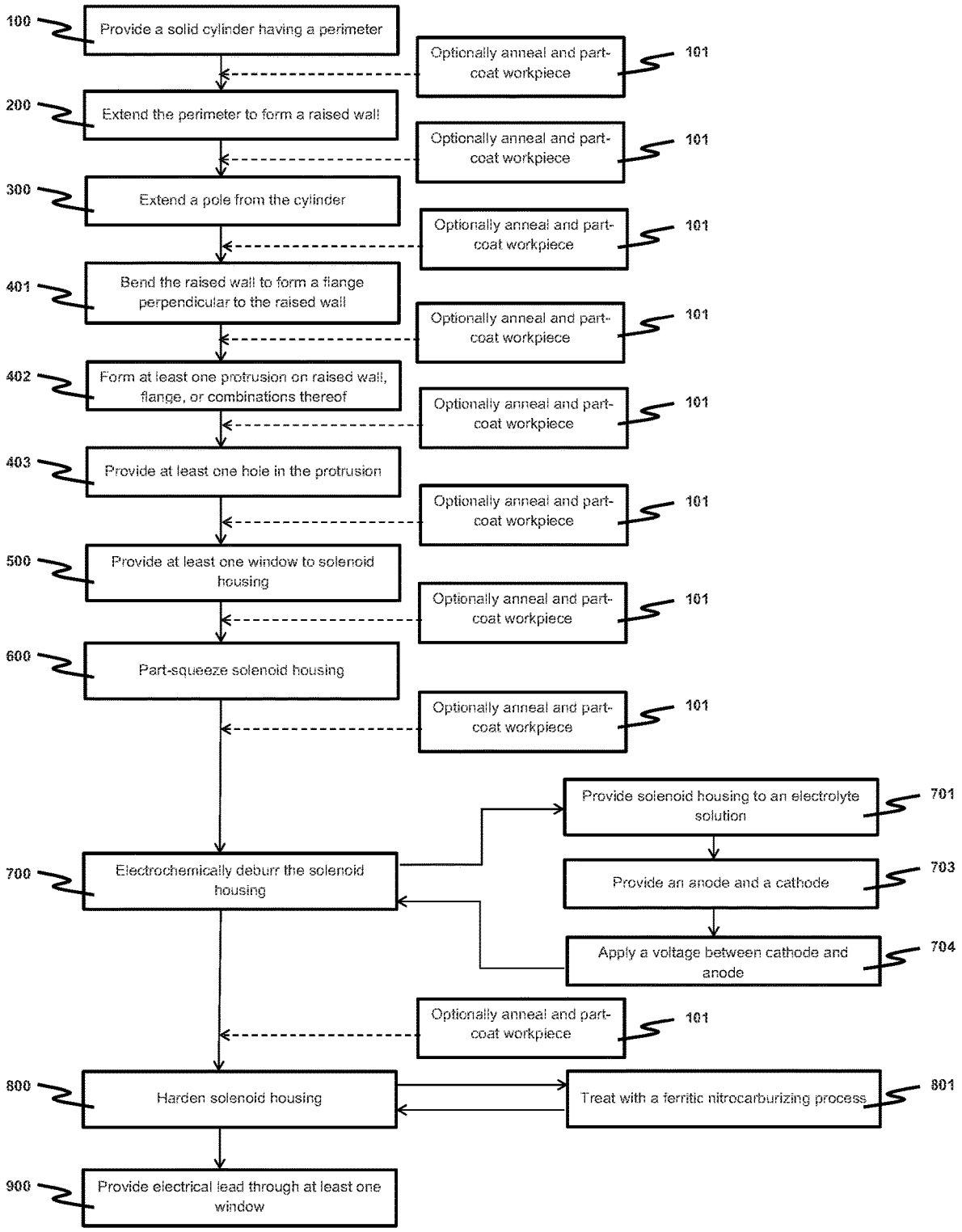
FIG. 7 is a flowchart depicting a method for providing the solenoid housing as depicted in FIG. 1.

FIG. 7 depicts another embodiment of the current invention, a method for providing a solenoid housing including the steps of providing a solid cylinder of malleable material (100), extending the perimeter to form a raised wall (200), extending a pole from the cylinder (300), bending the raised wall to form a flange perpendicular to the raised wall (401), forming at least one protrusion on the raised wall, the flange, or combinations thereof (402), providing at least one hole in at least one protrusion (402), providing at least one window to the solenoid housing (500), part-squeezing the solenoid housing (600), electrochemically deburring the solenoid housing (700), hardening the solenoid housing (800) and attaching at least one electrical lead through at least one window (900). In some embodiments of the invention, the step of electrochemically deburring the solenoid housing includes the steps of providing the solenoid housing to an electrolyte solution (701), providing an anode and cathode (702), and applying a voltage between cathode and anode (703). In some embodiments, the step of hardening the solenoid housing includes the additional step of treating with a ferritic nitrocarburizing process (801). Various embodiments of the method include the step of optionally annealing and part-coating the workpiece (101) before or after one or more of the following steps—providing the cylinder, extending the perimeter of the cylinder to form a raised wall, extending a pole from the cylinder, bending the raised wall to form a flange, forming the protrusions, providing holes in the protrusions, providing a window to the housing, part-squeezing the housing, electrochemically deburring the solenoid housing, and hardening the solenoid housing.

Figure 8A:
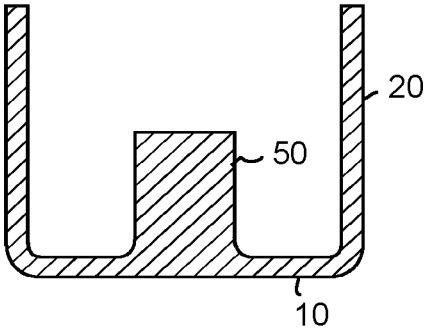
FIGS. 8A-8C depicts multiple cross-sectional views of the solenoid housing as depicted in FIG. 1.
Figure 8B:
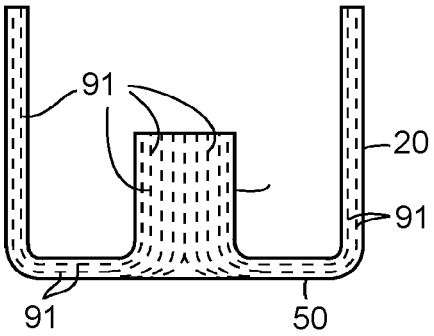
Figure 8C:
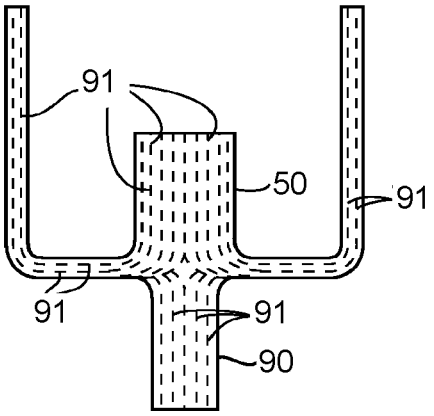

In another embodiment as shown in FIGS. 8A-8C, the solenoid housing further includes a plurality of grain lines (91) to be in a generally radial or generally axial direction. The electromagnetic field is transmitted from pole (50) to raised wall (20) via base (10). The plurality of grain lines (91) of the solenoid housing in a generally radial direction further facilitates transmission of the electromagnetic field because the electromagnetic field passes along the generally radial direction of the grain lines as the energy moves toward raised wall (20).

In typical prior art housings where the grain lines are not oriented, the grain lines may be oriented in a randomized, perpendicular, or angular relation relative to the travel of the electromagnetic field, in which case the grain lines inhibit the flow of the electromagnetic field rather than facilitate the flow.

In a further embodiment as shown in FIGS. 8B-8C, the solenoid housing includes a plurality of grain lines (91) to be in a generally axial direction extending along a length of the raised wall (20). As stated above, electromagnetic field is through a length of pole (50) to base (10). Therefore, the plurality of grain lines (91) in a generally axial direction facilitates transmission of the electromagnetic field through the solenoid housing because the energy passes along the generally axial direction of the grain lines as the energy moves toward base (10).

In typical prior art housings where the grain lines are not oriented, the grain lines may be randomized, perpendicular, or angular relative to the travel of the electromagnetic field, in which case the grain lines inhibit the flow of energy rather than facilitate the flow.

In another embodiment as shown in FIGS. 8C and 9A-9D, solenoid housing also includes a second center pole (90) opposite raised wall (20).

In another embodiment shown in FIGS. 8C and 9A-9D, second center pole (90) is provided in addition to first center pole (50).

It is understood that poles (50, 90) may differ in diameter or shape. In some embodiments as shown in FIGS. 9A-9D, second center pole (90) includes a cross section selected from the group consisting of a square, rectangle, triangle, pentagon, hexagon, octagon, polygon, and combinations thereof. As shown in FIGS. 9A-9D, examples of some of the resulting second center pole (90) cross sections or shapes are shown.

While the present invention has been particularly described, it is evident that many alternatives, modifications and variations will be apparent to those skilled in the art in light of the foregoing description. It is therefore contemplated that the appended claims will embrace any such alternatives, modifications, and variations as falling within the true scope and spirit of the present invention.

What is claimed is:

1. A solenoid housing comprising:

a base;

a raised wall extending from said base, said raised wall having an outer perimeter;

at least one protrusion extending from said outer perimeter;

at least one hole in said at least one protrusion; and a center pole extending from said base, said center pole having a top surface;

at least one window in said raised wall, said window having a bottom surface;

wherein said top surface of said center pole is closer to said base than said bottom surface of said at least one window;

wherein said base, said raised wall, said at least one protrusion, and said center pole are integrally connected as a single piece.

2. The solenoid housing of claim 1, wherein said at least one protrusion is generally perpendicular to said raised wall.

3. The solenoid housing of claim 1, further comprising at least one flange.

4. The solenoid housing of claim 3, wherein said at least one protrusion extends from said at least one flange.

5. The solenoid housing of claim 1, further comprising at least one electrical lead extending through said at least one window.

6. The solenoid housing of claim 1, wherein said window further includes a fitting.

7. The solenoid housing of claim 3, wherein the flange is a substantially perpendicular bend in said raised wall.

* * * * *